US011136738B2

(12) United States Patent
Trout

(10) Patent No.: US 11,136,738 B2
(45) Date of Patent: Oct. 5, 2021

(54) STRUCTURAL SHEET SPUR

(71) Applicant: The Trout Group, Inc., Geneva, IL (US)

(72) Inventor: Steven M. Trout, Geneva, IL (US)

(73) Assignee: The Trout Group, Inc., Geneva, IL (US)

( * ) Notice: Subject to any disclaimer, the term of this patent is extended or adjusted under 35 U.S.C. 154(b) by 0 days.

(21) Appl. No.: 16/832,748

(22) Filed: Mar. 27, 2020

(65) Prior Publication Data

US 2020/0308793 A1 Oct. 1, 2020

Related U.S. Application Data

(60) Provisional application No. 62/826,415, filed on Mar. 29, 2019.

(51) Int. Cl.
*E02D 5/14* (2006.01)
*E02D 5/72* (2006.01)

(52) U.S. Cl.
CPC ..... *E02D 5/14* (2013.01); *E02D 5/72* (2013.01)

(58) Field of Classification Search
CPC ..... E02D 5/14; E02D 5/06; E02D 5/72
See application file for complete search history.

(56) References Cited

U.S. PATENT DOCUMENTS

| | | | | |
|---|---|---|---|---|
| 732,401 | A * | 6/1903 | Dungan | E02D 19/04 405/14 |
| 878,141 | A | 2/1908 | Jackson | |
| 3,688,509 | A | 9/1972 | Van Weele | |
| 3,851,490 | A * | 12/1974 | Matsushita | E02D 7/24 405/248 |
| 5,437,520 | A * | 8/1995 | Cherry | E02D 5/14 405/276 |
| 5,547,318 | A | 8/1996 | Decker | |
| 5,584,610 | A * | 12/1996 | Simpson | E02D 5/00 405/248 |
| 5,938,375 | A | 8/1999 | Wheeler, Jr. et al. | |
| 6,427,402 | B1 | 8/2002 | White | |
| 6,568,881 | B2 * | 5/2003 | Long | E02D 7/24 175/21 |
| 6,664,509 | B2 | 12/2003 | Moulin et al. | |
| 9,528,241 | B2 | 12/2016 | Hargrave et al. | |
| 10,584,455 | B2 * | 3/2020 | Pedrocco | E02D 7/24 |
| 2019/0292745 | A1 * | 9/2019 | Arntz | E02D 7/18 |

FOREIGN PATENT DOCUMENTS

| | | | |
|---|---|---|---|
| DE | 19846758 | * | 10/1998 |
| EP | 628662 | * | 5/1984 |
| JP | 2004-52306 A | | 2/2004 |

(Continued)

OTHER PUBLICATIONS

Notification of Transmittal of the International Search Report and the Written Opinion of the International Seaching Authority, or the Declaration dated Jul. 13, 2020 for International Application No. PCT/US2020/025367 (15 pages).

*Primary Examiner* — Carib A Oquendo
(74) *Attorney, Agent, or Firm* — Taylor IP, P.C.

(57) ABSTRACT

A structural pile sheet spur including a void creating section located in a fore part of the spur, a pile sheet interfacing section located in an aft part of the spur, and a fluid delivery passageway located in or adjacent to the pile sheet interfacing section.

20 Claims, 4 Drawing Sheets

(56) References Cited

FOREIGN PATENT DOCUMENTS

| | | |
|---|---|---|
| JP | 2006-9468 | 1/2006 |
| JP | 2012-26216 | 2/2012 |
| JP | 2015057527 | * 11/2013 |
| KR | 20-0297427 | 12/2002 |
| KR | 10-1065017 | 9/2011 |

* cited by examiner

STRUCTURAL SHEET SPUR

CROSS REFERENCE TO RELATED APPLICATIONS

This is a non-provisional application based upon U.S. provisional patent application Ser. No. 62/826,415, entitled "STRUCTURAL SHEET SPUR", filed Mar. 29, 2019, which is incorporated herein by reference.

BACKGROUND OF THE INVENTION

1. Field of the Invention

The present invention relates to sheet pile walls, and, more particularly, to a system for installing and sealing pile walls.

2. Description of the Related Art

Sheet pile retaining walls are typically used in soft soils and tight spaces, but are also utilized in dense or even rocky soils. Sheet pile walls are driven into the ground and are composed of a variety of material including steel, vinyl, aluminum, fiberglass or wood planks.

It is well known in the industry that steel sheet pile joints are not impermeable to water table infiltration. There are currently several available joint sealing systems on the market to inhibit the migration of water and contaminants through the sheet joints. The products typically consist of a waterproofing agent to be applied to the length of the joints prior to the sheet piles being driven into the ground. The violent and forceful installation process of the sheeting will compromise the previously installed waterproofing system. During the installation, high levels of friction are generated which leads to scouring of the waterproofing agent out from the joints and allows the soil particles to enter and flow past the joint.

What is needed in the art is a sealing system that is easily adaptable to the current type of pile sheets and reliably seals the sheet joints.

SUMMARY OF THE INVENTION

The present invention provides a sheet pile wall seam sealing system.

The invention in one form is directed to a structural pile sheet spur including a void creating section located in a fore part of the spur, a pile sheet interfacing section located in an aft part of the spur, and a fluid delivery passageway located in or adjacent to the pile sheet interfacing section.

The invention in another form is directed to a structural pile sheet system including a first pile sheet, a second pile sheet, and a spur. The spur having a void creating section located in a fore part of the spur, a pile sheet interfacing section located in an aft part of the spur, and a fluid delivery passageway located in or adjacent to the pile sheet interfacing section. The pile sheet interfacing section being fitted to a bottom portion of the first pile sheet. The first pile sheet being driven into earth. The second pile sheet being driven into the earth and coming into contact with the spur.

The invention in still another form is directed to a method of sealing structural pile sheets. The method including the steps of coupling, driving the first pile sheet, aligning, driving a second pile sheet, passing and ejecting. The coupling step includes coupling a spur to the first pile sheet. The first driving step includes driving the first pile sheet with the spur into the earth, the spur thereby leaving a void along a portion of the first pile sheet. The aligning step includes aligning the second pile sheet with the first pile sheet. The second driving step includes driving the second pile sheet into the earth, the second pile sheet being proximate to the spur, the second pile sheet having an edge in the void. The passing step includes passing a sealing material down a fluid delivery tube to the spur. The ejecting step includes ejecting the sealing material to fill the void thereby sealing the first pile sheet to the second pile sheet.

An advantage of the present invention is that the sealing of the seam between adjacent pile sheets takes place after the sheets are in position in the ground, thereby improving the seal.

Another advantage is that the sealing material is not pushed out of the joint during the joining of the adjacent sheets as in the prior art.

Yet another advantage is that the sealing takes place from the bottom up.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
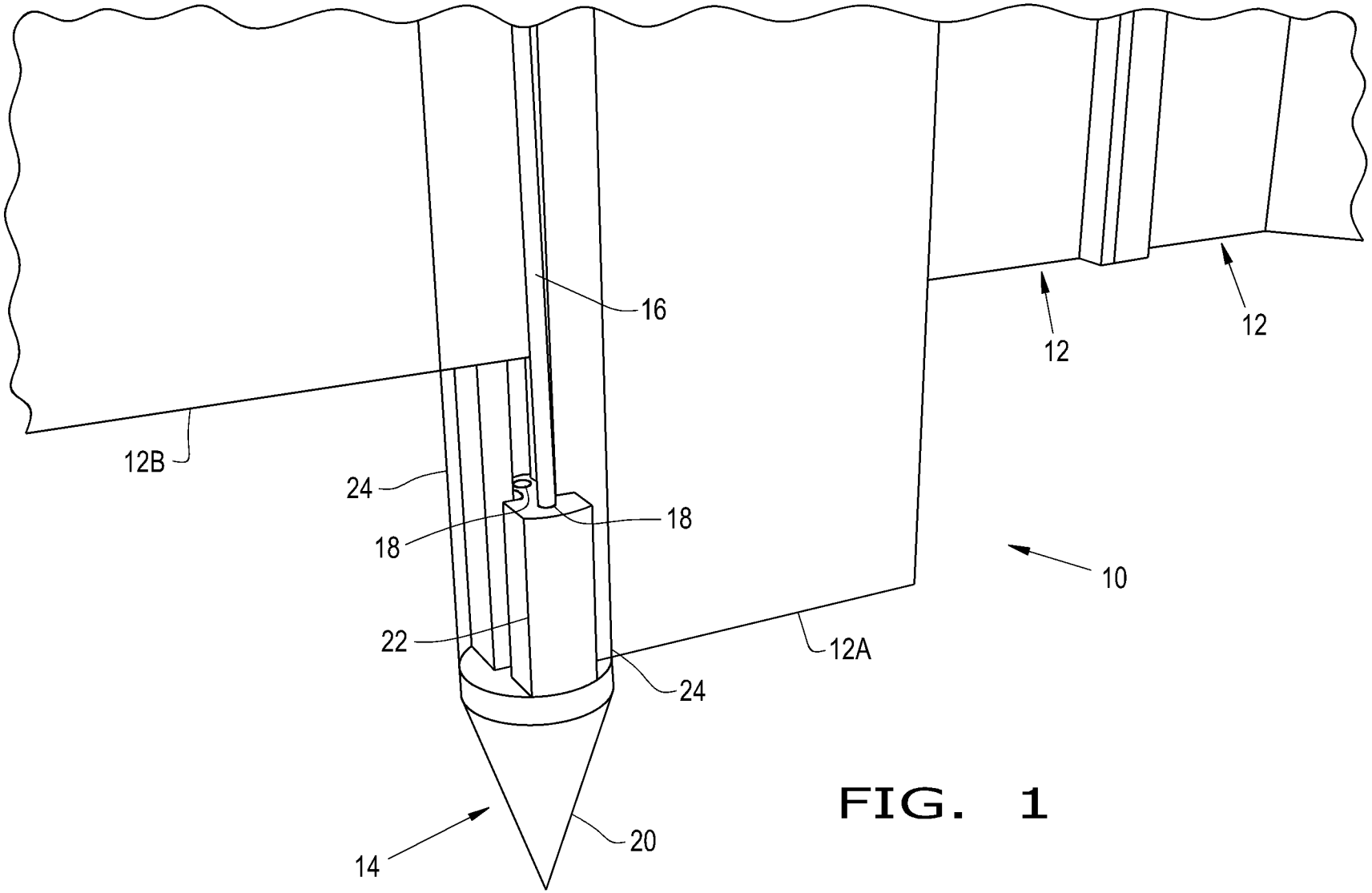
FIG. 1 is a perspective view of structural pile sheets being joined together in an underground environment (the ground not being shown for the sake of clarity) with an embodiment of a sheet spur of the present invention having been driven into the ground along with a pile sheet.
Figure 2:
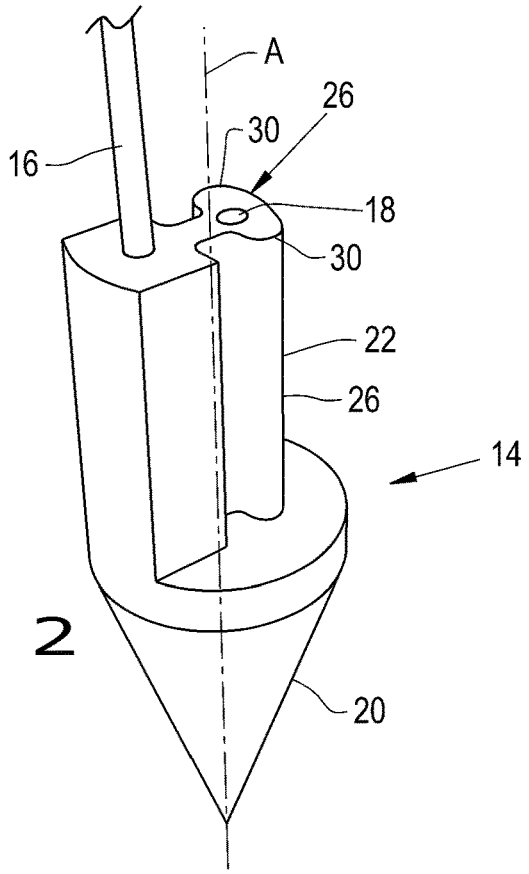
FIG. 2 is a perspective view of the sheet spur of FIG. 1.
Figure 3:
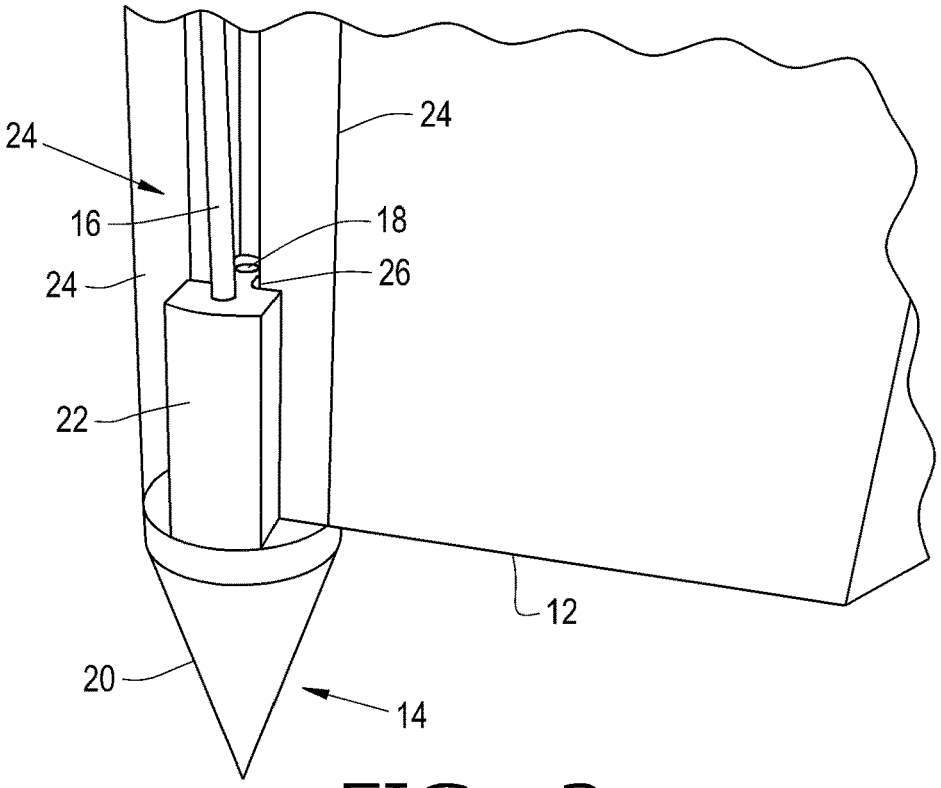
FIG. 3 is another perspective view of the sheet spur of FIGS. 1 and 2 positioned in a channel of pile sheets.

Referring now to the drawings, and more particularly to FIGS. 1-3, there is shown a pile system 10, including representative pile sheets 12A and 12B, and sheet spur 14. Sheet spur 14 includes a grout injection tube 16 attached to interfacing section 22 with a grout ejection port at an end of a passageway 18. Spur 14 has a void creating section 20, which is conically shaped that creates a void 24 in the soil as it is driven into the ground slidingly coupled to sheet 12A. Spur 14 additionally includes a pile key 26 that interacts with the slot in sheets 12 in which spur 14 is slid, allowing spur 14 to be welded to sheet 12 in an aligned manner. Sheet 12B is similarly driven into the ground with another spur 14, not pictured here, but similar to that illustrated.

The invention relates to the use of a prefabricated metal spur 14 attached to a segment of steel sheet pile 12A adjacent to the connecting joint at the base. Spur 14 is designed to accomplish two tasks that ultimately result in a sealed joint between two sheet piles 12A and 12B. The first task is to create a void 24 in the soil around the sheet pile joint as spur 14 travels through the ground. The second task is to inject a non-permeable material into the void 24 to seal the joint of sheets 12A and 12B. This will ultimately prevent the migration of contaminants or water from passing between the sheet pile joints.

Often, cells are created out of sheet pile with the intent to prevent contamination migration. Another purpose of a water tight joint is when sheet piles 12 are used as soil retention during excavations for new construction. An example of a new construction application is during excavation near an existing structure, sheet pile system 10 will be used for soil retention to support that structure. If the excavation exceeds the depth of the water table, water can enter the excavation through the sheet joints of the prior art causing undesirable site conditions. The unimpeded inflow of ground water will necessitate the use of constant site dewatering and even worse, may instigate structure or utility settlement outside the excavation by conveying soil particles from under existing structures through the joints and into the new excavation. These issues are eliminated, or at least significantly reduce by using the present invention.

The advantage of the Sheet Spur 14 is it creates a void 24 adjacent to the joint to be sealed either the entire length or at any desired locations along the length. The Sheet Spur 14 includes an integrated injection system can be used to fill the void 24 during the process of installing the sheets 12 or after the initial sheet 12A and connected adjacent sheet 12B has been driven to depth. Once the void is filled by injecting a slurry down grout injection tube 16 that is then ejected out of the ejection port at an end of passageway 18, typically with a grout slurry, the joints will be impervious to water or contamination migration through the joints.

Initially Sheet Spur 14 is attached to a sheet 12A and the sheet 12A is ready to be driven into the ground, the grout hose 16 is connected to the injection port on the Spur 14. The opposite end of the hose 16 is connected to a grout pump that will begin injecting upon the sheet 12A first penetrating the ground. Grout flow and volumes are easily monitored from the surface allowing the pump operator to calibrate the injection rates without affecting the pile driving process. Once the sheet is driven to depth and desired grout volumes have been achieved, the injection tube 16 can be severed at grade and the process for that sheet is complete.

The Sheet Spur's primary function is to inject a sealing slurry around sheet pile joints, but it can also be utilized for additional applications in more granular soils. The first alternative application is it can be used with most any joint configuration as a protection device for other preplaced sealant products. The Spur prevents soils from entering the sealed joint and scouring out the sealant product. Another application is that often times sheet pile are driven in to urban fill or soils that contain large cobbles, boulders, or other large debris. In these instances where obstructive obstacles exist, the Sheet Spur 14 acts as a shield and a guide to protect the leading edge of the sheet from distorting and ultimately cause overall alignment issues with the sheets. These distortions and alignment issues of the prior art can then propagate to adjacent sheets causing the interlocking joints to separate and form large gaps. These large gaps between the sheets allow unobstructed flow of water or contaminants, and inhibit the uniform placement of the sheets, or cause alignment issues with the sheets.

In a cohesive soil, the void should remain open to allow injection during or after sheet installation. But in granular soils, the Sheet Spur is designed to displace large rocks or debris from the injectable void area. If the void isn't immediately filled with the waterproofing agent, the granular soils could be agitated by the installation process and fall back into newly created void. The Sheet Spur's integrated injection system allows the injection of the waterproofing agent during or after the installation process rendering the joint water tight.

Figure 4:
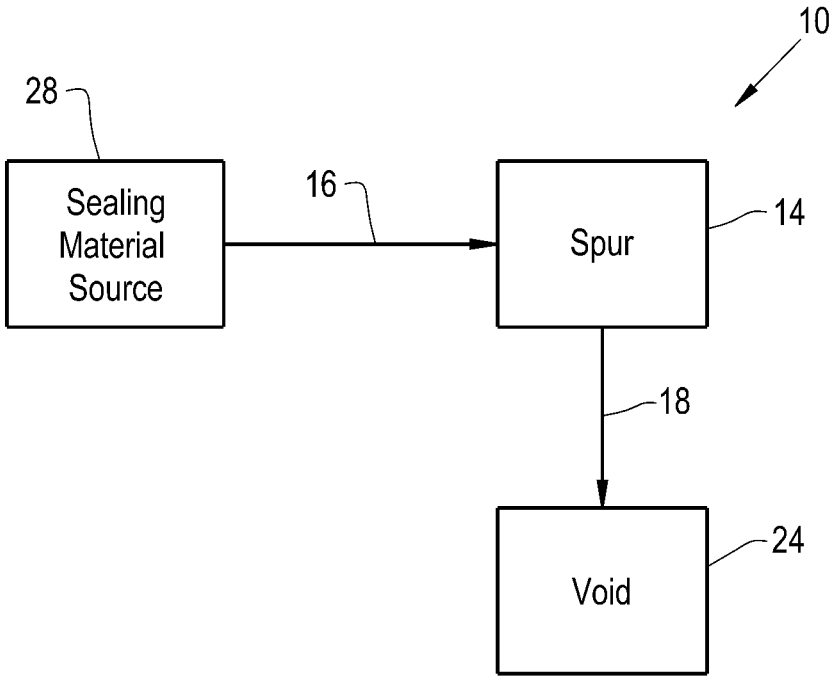
FIG. 4 is a functional block diagram illustrating a material source for the sealing material that is delivered through the spur of FIGS. 1-3.

Now, additionally referring to FIG. 4, structural pile sheet spur 14 includes a void creating section 20 located in a fore part of spur 14, a pile sheet interfacing section 22 located in an aft part of spur 14, and a fluid delivery passageway 18 located in or adjacent to pile sheet interfacing section 22. All fore and aft references refer to a direction of travel along longitudinal axis A as spur 14 is driven into the earth along with sheet 12 to which it is attached. Fluid delivery tube 16 is coupled to, or is a part of, fluid delivery passageway 18. Although passageway 18 is shown as part of spur 14, it is also contemplated that passageway 18 could be integral with tube 16, and could just be attached to an aft (top part as illustrated) portion of spur 14. Fluid delivery passageway 18, as illustrated, is located in the pile sheet interfacing section 22. Fluid delivery passageway 18 is coupled to delivery tube 16 to allow sealing material from a sealing material source 28 that can be a grout sealing material, to flow through delivery tube 16 and through fluid delivery passageway 18. The sealing material is released into the slot or channel where sheets 12A and 12B are joined, and into void 24 to fill them with the sealing material from the bottom upward.

The openings of fluid delivery passageway 18 are in the aft direction of spur 14. Void creating section 20 is symmetrical about a longitudinal axis A and, as illustrated, is conically shaped. Pile sheet interfacing section 22 has key 26 that interacts with the slot or channel of sheets 12, key 26 has two protrusions 30 that interacts with a channel in pile sheets 12. Pile sheet interfacing section 22 extends forward to an aft portion of void creating section 20.

The aft end of the void creating section 20 receives an end of the pile sheet 12 to allow spur 14 to be driven into the earth as pile sheet 12 is driven downward. Key 26 is inserted into a part of sheet 12 and it may be secured there with a fastener, a near interference fit, a deformation of sheet 12 once spur 14 is inserted, an adhesive, a weld, or other fastening technique. Fluid delivery passageway 18 opens between protrusions 30 thereby allowing the sealing material to exit in an upward direction.

Fluid delivery passageway 18 is located in or adjacent to the pile sheet interfacing section 22, and pile sheet interfacing section 22 is fitted to a bottom portion of the pile sheet 12 before being driven into the earth. Then a second pile sheet is driven into the earth and comes into contact with spur 14 as the second sheet reaches the depth of the first sheet 12. Tube 16 extends down into void 24 when the sheet having spur 14 is driven into the ground. Fluid delivery tube 16 delivers sealing material through the fluid delivery passageway 18 to fill void 24 in the earth created by void creating section 20 of spur 14.

Figure 5:
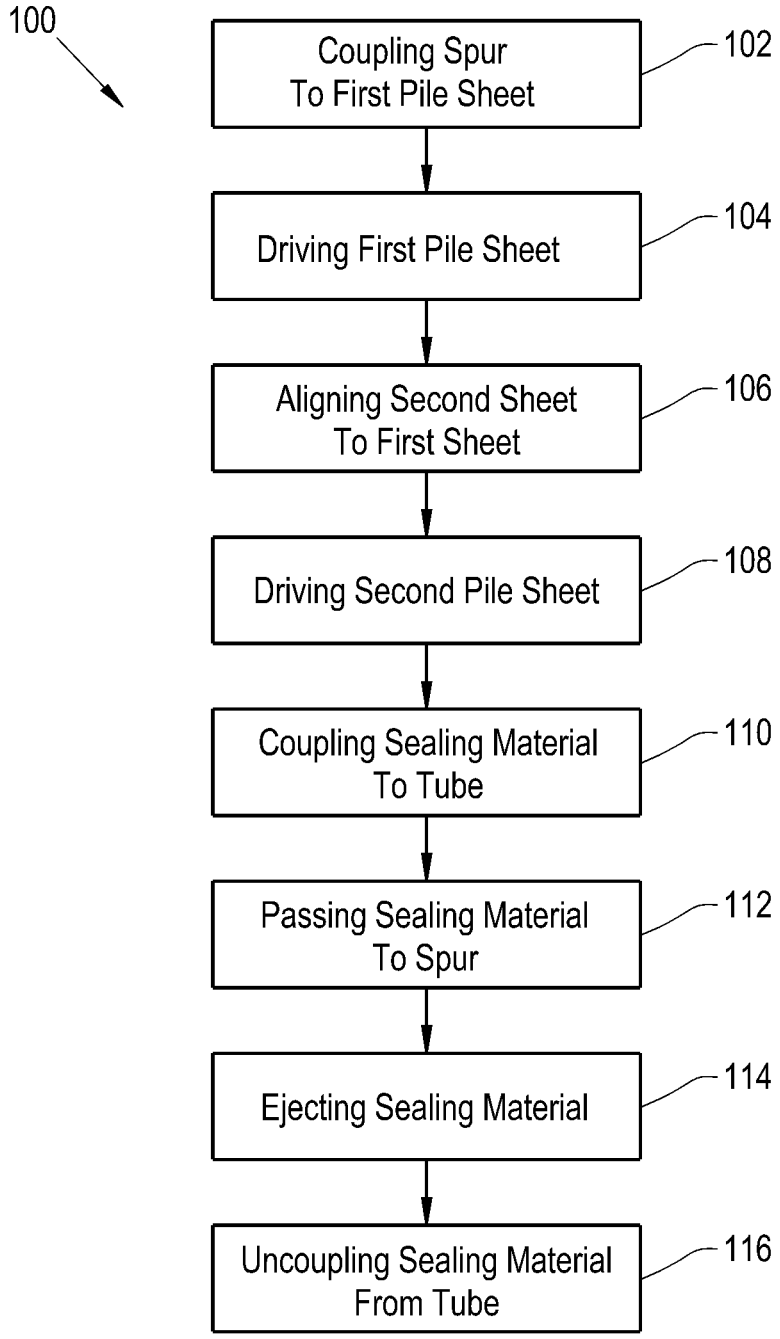
FIG. 5 is a flow diagram illustrating the function of the sealing system that utilizes the spur of FIGS. 1-4.

Now, additionally referring to FIG. 5 a method of sealing structural pile sheets 100 is illustrated. Method 100 includes the steps of coupling 102, driving the first pile sheet 104, aligning 106, driving a second pile sheet 108, coupling 110, passing 112, ejecting 114, and uncoupling 116. Coupling step 102 includes coupling spur 14 to first pile sheet 12A. The first driving step 104 includes driving first pile sheet 12A along with spur 14 into the earth, spur 14 thereby leaving void 24 along a portion of the first pile sheet 12A. The aligning step 106 includes aligning the second pile sheet 12B with the first pile sheet 12A. The second driving step 108 includes driving the second pile sheet 12B into the earth, second pile sheet 12B being thereby positioned proximate to spur 14, the second pile sheet 12B having an edge in void 24. Coupling step 110 includes coupling sealing material source 28 to tube 16. The passing step 112 includes passing a sealing material from source 28 down fluid delivery tube 16 to spur 14. The ejecting step 114 includes ejecting the sealing material to fill void 24 thereby sealing first pile sheet 12A to second pile sheet 12B.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A structural pile sheet spur, comprising:
- a void creating section located in a fore part of the spur, the void creating section arranged to displace soil thereby creating a void in the soil when the spur is coupled to a first pile sheet and is driven into the soil;
- a pile sheet interfacing section located in an aft part of the spur that engages the first pile sheet, a second pile sheet engaged to the first pile sheet and driven into the soil until proximate to the spur, the void in the soil extending from the spur along an intersection of the first pile sheet and the second pile sheet; and
- a fluid delivery passageway located in or adjacent to the pile sheet interfacing section, the fluid delivery passageway delivers fluid to the void in the soil thereby causing the fluid to contact the soil and the pile sheet by way of the void in the soil.

2. The structural pile sheet spur of claim 1, further comprising a fluid delivery tube coupled to, or a part of, the fluid delivery passageway.

3. The structural pile sheet spur of claim 2, wherein the fluid delivery passageway is located in the pile sheet interfacing section, the fluid delivery passageway being coupled to the delivery tube to allow grout to flow through the delivery tube and through the fluid delivery passageway.

4. The structural pile sheet spur of claim 3, wherein openings of the fluid delivery passageway are in an aft direction.

5. The structural pile sheet spur of claim 1, wherein the void creating section is symmetrical about a longitudinal axis.

6. The structural pile sheet spur of claim 5, wherein the void creating section is conically shaped.

7. The structural pile sheet spur of claim 1, wherein the pile sheet interfacing section includes at least one protrusion that interacts with a channel in a pile sheet.

8. The structural pile sheet spur of claim 7, wherein the pile sheet interfacing section extends to an aft portion of the void creating section.

9. The structural pile sheet spur of claim 8, wherein the aft end of the void creating section receives an end of the pile sheet to allow the spur to be driven into earth as the pile sheet is driven.

10. The structural pile sheet spur of claim 9, wherein the at least one protrusion is two protrusions, the fluid delivery passageway having one opening between the two protrusions.

11. A structural pile sheet system, comprising:
- a plurality of pile sheets including a first pile sheet and a second pile sheet; and
- a spur, the spur having:
  - a void creating section located in a fore part of the spur, the void creating section arranged to create a void in soil as the spur is moved along with the first pile sheet into the soil;
  - a pile sheet interfacing section located in an aft part of the spur; and
  - a fluid delivery passageway located in or adjacent to the pile sheet interfacing section, the pile sheet interfacing section being fitted to a bottom portion of the first pile sheet, the first pile sheet being driven into earth with the spur to create the void in the soil, the second pile sheet being driven into the earth and coming into contact with the spur, the void in the soil being adjacent to an intersection of the first pile sheet and the second pile sheet, a fluid delivered through the fluid delivery passageway into the void in the soil with the fluid contacting the first pile sheet, the second pile sheet and the soil surrounding the void adjacent to the intersection.

12. The structural pile sheet system of claim 11, further comprising a fluid delivery tube coupled to, or a part of, the fluid delivery passageway, the fluid delivery tube delivering a material through the fluid delivery passageway to fill a void in the earth created by the void creating section of the spur.

13. The structural pile sheet system of claim 12, wherein the fluid delivery passageway is located in the pile sheet interfacing section, the fluid delivery passageway being coupled to the delivery tube to allow grout to flow through the delivery tube and through the fluid delivery passageway.

14. The structural pile sheet system of claim 13, wherein openings of the fluid delivery passageway are in an aft direction.

15. A method of sealing structural pile sheets, the method comprising the steps of:
- coupling a spur to a first pile sheet;
- driving the first pile sheet with the spur into the earth, the spur contacting soil of the earth thereby leaving a void in the soil along a portion of the first pile sheet;
- aligning a second pile sheet with the first pile sheet;
- driving the second pile sheet into the earth, the second pile sheet being proximate to the spur, the second pile sheet having an edge in the void of the soil;
- passing a sealing material down a fluid delivery tube to the spur; and
- ejecting the sealing material to thereby contact a portion of the first pile sheet and the second pile sheet along an intersection of the first pile sheet and the second pile sheet and in the void, the sealing material also contacting the soil along the void in the soil and filling the void thereby sealing the first pile sheet to the second pile sheet along the intersection.

16. The method of claim 15, further comprising the steps of:
- coupling a sealing material source to the fluid delivery tube prior to the passing step; and
- uncoupling the sealing material source from the fluid delivery tube after the ejecting step.

17. The method of claim 15, wherein the spur includes:
- a void creating section located in a fore part of the spur;
- a pile sheet interfacing section located in an aft part of the spur; and a fluid delivery passageway located in or adjacent to the pile sheet interfacing section.

18. The method of claim 17, wherein the fluid delivery tube is coupled to, or a part of, the fluid delivery passageway.

19. The method of claim 18, wherein the fluid delivery passageway is located in the pile sheet interfacing section, the fluid delivery passageway being coupled to the delivery tube to allow sealing material to flow through the delivery tube and through the fluid delivery passageway.

20. The method of claim 17, wherein the void creating section is symmetrical about a longitudinal axis, the void creating section being conically shaped.

* * * * *